US007830319B2

(12) United States Patent
Cohen et al.

(10) Patent No.: US 7,830,319 B2
(45) Date of Patent: Nov. 9, 2010

(54) WIDEBAND ANTENNA SYSTEM FOR GARMENTS

(76) Inventors: Nathan Cohen, 2 Ledgewood Pl., Belmont, MA (US) 02478; David Moschella, 195 Follen Rd., Lexington, MA (US) 02421

( * ) Notice: Subject to any disclaimer, the term of this patent is extended or adjusted under 35 U.S.C. 154(b) by 143 days.

(21) Appl. No.: 12/118,957

(22) Filed: May 12, 2008

(65) Prior Publication Data

US 2009/0153420 A1 Jun. 18, 2009

Related U.S. Application Data

(63) Continuation of application No. 11/210,978, filed on Aug. 24, 2005, now abandoned.

(60) Provisional application No. 60/603,882, filed on Aug. 24, 2004.

(51) Int. Cl.
*H01Q 1/12* (2006.01)

(52) U.S. Cl. ..... 343/718; 343/700 MS

(58) Field of Classification Search ..... 343/718, 343/702, 700 MS, 846
See application file for complete search history.

(56) References Cited

U.S. PATENT DOCUMENTS

| | | | |
|---|---|---|---|
| 3,079,602 | A | 2/1963 | Hamel et al. |
| 3,249,946 | A | 5/1966 | Flanagan |
| 3,689,929 | A | 9/1972 | Moody |
| 3,810,183 | A | 5/1974 | Krutsinger et al. |
| 3,811,128 | A | 5/1974 | Munson |
| 4,318,109 | A | 3/1982 | Weathers |
| 4,358,769 | A | 11/1982 | Tada et al. |
| 4,381,566 | A | 4/1983 | Kane |
| 4,652,889 | A | 3/1987 | Bizouard et al. |
| 4,656,482 | A | 4/1987 | Peng |
| 5,006,858 | A | 4/1991 | Shirosaka |
| 5,111,211 | A | 5/1992 | Dahlberg |
| 5,164,738 | A | 11/1992 | Walter et al. |
| 5,313,216 | A | 5/1994 | Wang et al. |
| 5,355,318 | A | 10/1994 | Dionnet et al. |
| 5,363,114 | A | 11/1994 | Shoemaker |
| 5,453,752 | A | 9/1995 | Wang |
| 5,608,413 | A | 3/1997 | MacDonald |
| 5,844,525 | A | 12/1998 | Hayes et al. |
| 5,995,064 | A | 11/1999 | Yanagisawa et al. |
| 6,104,349 | A | 8/2000 | Cohen |
| 6,127,977 | A | 10/2000 | Cohen |
| 6,140,975 | A | 10/2000 | Cohen |
| 6,323,809 | B1 | 11/2001 | Maloney et al. |
| 6,356,238 | B1 | 3/2002 | Gainer et al. |

(Continued)

OTHER PUBLICATIONS

Kim, Y., Jaggard, D., "The Fractal Random Array", Proc. IEEE 74, 1278-1280 (1986).

(Continued)

*Primary Examiner*—HoangAnh T Le
(74) *Attorney, Agent, or Firm*—McDermott Will & Emery LLP

(57) ABSTRACT

A portable antenna system includes an antenna that is substantially defined by one or more portions that include electrically conductive self-similar extensions. The system also includes an article of clothing in which the antenna is attached to a surface of the article of clothing such that electrically conductive self-similar extensions extend across the surface of the article of clothing.

10 Claims, 4 Drawing Sheets

U.S. PATENT DOCUMENTS

| | | | |
|---|---|---|---|
| 6,476,766 | B1 | 11/2002 | Cohen |
| 6,603,440 | B2 | 8/2003 | Howard |
| 6,867,740 | B2 | 3/2005 | Goodyear |
| 6,947,764 | B2 | 9/2005 | Carillo et al. |
| 6,985,122 | B2 | 1/2006 | Cohen |
| 2003/0214389 | A1 | 11/2003 | Arneson et al. |
| 2003/0230614 | A1 | 12/2003 | Karenga |

OTHER PUBLICATIONS

Pfeiffer, A., "The Pfeiffer Quad Antenna System," QST., pp. 28-31, (1994).

WIDEBAND ANTENNA SYSTEM FOR GARMENTS

RELATED APPLICATIONS AND TECHNICAL FIELD

This application is a continuation of U.S. patent application Ser. No. 11/210,978 filed 24 Aug. 2005, which claims priority to U.S. Provisional Patent Application Ser. No. 60/603,882, filed Aug. 24, 2004, the entire contents of both of which application are incorporated herein by reference. This application is also a continuation-in-part of U.S. patent application Ser. No. 11/778,734 (FRTK-1CN6) filed 17 Jul. 2007, which is a continuation of U.S. patent application Ser. No. 10/243,444 (FRTK-1CN5) filed 13 Sep. 2002, which is a continuation of U.S. application Ser. No. 08/512,954 (FRTK-1) filed 9 Aug. 1995, now issued as U.S. Pat. No. 6,452,553; this application is also a continuation-in-part of U.S. patent application Ser. No. 11/390,323 (FRTK-3CN2CN) filed 27 Mar. 2006, which is a continuation of U.S. patent application Ser. No. 10/287,240 (FRTK-3CN2) filed 4 Nov. 2002, which in turn is a continuation of U.S. patent application Ser. No. 09/677,645 (FRTK-3CN) filed 3 Oct. 2000, which in turn is a continuation of both U.S. patent application Ser. No. 08/967,375 (FRTK-1CN4) filed 7 Nov. 1997 and U.S. patent application Ser. No. 08/965,914 (FRTK-3) filed 7 Nov. 1997, issued as U.S. Pat. No. 6,127,977 (3 Oct. 2000); this application is also a continuation-in-part of U.S. patent application Ser. No. 11/867,284 (FRTK-6CN2) filed 4 Oct. 2007, which is a continuation of U.S. patent application Ser. No. 11/327,982 (FRTK-6CN) filed 9 Jan. 2006, which is a continuation of U.S. patent application Ser. No. 10/971,815 (FRTK-6) filed Oct. 22, 2004 now issued as U.S. Pat. No. 6,985,122, which claimed priority to U.S. Provisional Patent Application Ser. No. 60/513,497, filed Oct. 22, 2003.

This application is also related to the following U.S. application, of common assignee, and the contents of which are incorporated herein in their entirety by reference: "Antenna System for Radio Frequency Identification," U.S. patent application Ser. No. 10/971,815 (FRTK-6) filed 22 Oct. 2004.

This disclosure relates to antenna systems and, more particularly, to wideband antennas that are incorporated into garments.

BACKGROUND

Antennas are used to typically radiate and/or receive electromagnetic signals, preferably with antenna gain, directivity, and efficiency. Practical antenna design traditionally involves trade-offs between various parameters, including antenna gain, size, efficiency, and bandwidth.

Antenna design has historically been dominated by Euclidean geometry. In such designs, the closed area of the antenna is directly proportional to the antenna perimeter. For example, if one doubles the length of an Euclidean square (or "quad") antenna, the enclosed area of the antenna quadruples. Classical antenna design has dealt with planes, circles, triangles, squares, ellipses, rectangles, hemispheres, paraboloids, and the like.

With respect to antennas, prior art design philosophy has been to pick a Euclidean geometric construction, e.g., a quad, and to explore its radiation characteristics, especially with emphasis on frequency resonance and power patterns. Unfortunately antenna design has concentrated on the ease of antenna construction, rather than on the underlying electromagnetics, which can cause a reduction in antenna performance.

Antenna systems that incorporate a Euclidean geometry include man-portable communication antennas such as monopole antennas. Typically these types of antennas include a wire or rod that may be extended to a deployed position that is located above the antenna carrier's head. As such, these extendable antennas may provide a visual signature that may disclose the location of the person carrying the antenna (such as a soldier in the field). Additionally, these antennas implement a monopole design that typically exhibit a narrow instantaneous bandwidth.

SUMMARY OF THE DISCLOSURE

In accordance with an aspect of the disclosure, a portable antenna system includes an antenna that is substantially defined by one or more portions that include electrically conductive self-similar extensions. The system also includes an article of clothing in which the antenna is attached to a surface of the article of clothing such that electrically conductive self-similar extensions extend across the surface of the article of clothing.

In one embodiment, the self-similar extensions may include two or more angular bends. The system may further include a co-planar feed connected to the antenna for transmitting and/or receiving electromagnetic signals through the antenna. Each self-similar extension may incorporate a fractal geometry. Furthermore, the antenna may transmit and/or receive electromagnetic energy across a spectral bandwidth that is defined by a ratio of at least 5:1. The system may also include a dielectric plate to which the antenna may be mounted. The dielectric plate may capable of deflecting projectiles. The antenna may be mounted to various locations on clothing. For example, the antenna may be mounted on an internal clothing layer or to an exterior surface of the article of clothing. Various articles of clothing may be used, for example, the article of clothing may be a vest.

In accordance with another aspect, a portable antenna system includes an antenna that is substantially defined by one or more portions that include electrically conductive self-similar extensions. The portable antenna system also includes a pouch, in which the antenna is contained. The pouch is also configured for mounting to a clothing surface.

In one embodiment, the system may further include a plate upon which the pouch is positioned such that the plate separates the antenna from the body of a person wearing clothing that includes the clothing surface. The self-similar extensions may include two or more angular bends. The system may also include a co-planar feed that is connected to the antenna for transmitting and/or receiving electromagnetic signals. Each self-similar extension may incorporate a fractal geometry. The pouch may include a layer of foam dielectric material or a layer of solid dielectric material. The pouch may include a fibrous dielectric material such as Tyvek™. The plate may include a projectile deflecting material.

In accordance with another aspect, a portable antenna system includes an antenna that is substantially defined one or more portions that include electrically conductive self-similar extensions. The system also includes a plate in which the antenna is mounted upon, and a garment in which the plate is attached to a clothing surface included in the garment.

In one embodiment, the plate may include a projectile deflecting material and/or a dielectric material. The garment may be a vest. The plate may be attached to a surface of the garment such that when worn, the antenna extends across the back of the person wearing the garment. Each self-similar extension may incorporate a fractal geometry. The antenna may transmit and/or receive electromagnetic energy across a spectral bandwidth that is defined by a ratio of at least 5:1.

Additional advantages and aspects of the present disclosure will become readily apparent to those skilled in the art from the following detailed description, wherein embodiments of the present invention are shown and described, simply by way of illustration of the best mode contemplated for practicing the present invention. As will be described, the present disclosure is capable of other and different embodiments, and its several details are susceptible of modification in various obvious respects, all without departing from the spirit of the present disclosure. Accordingly, the drawings and description are to be regarded as illustrative in nature, and not as limitative.

DETAILED DESCRIPTION OF THE EMBODIMENTS

Figure 1:
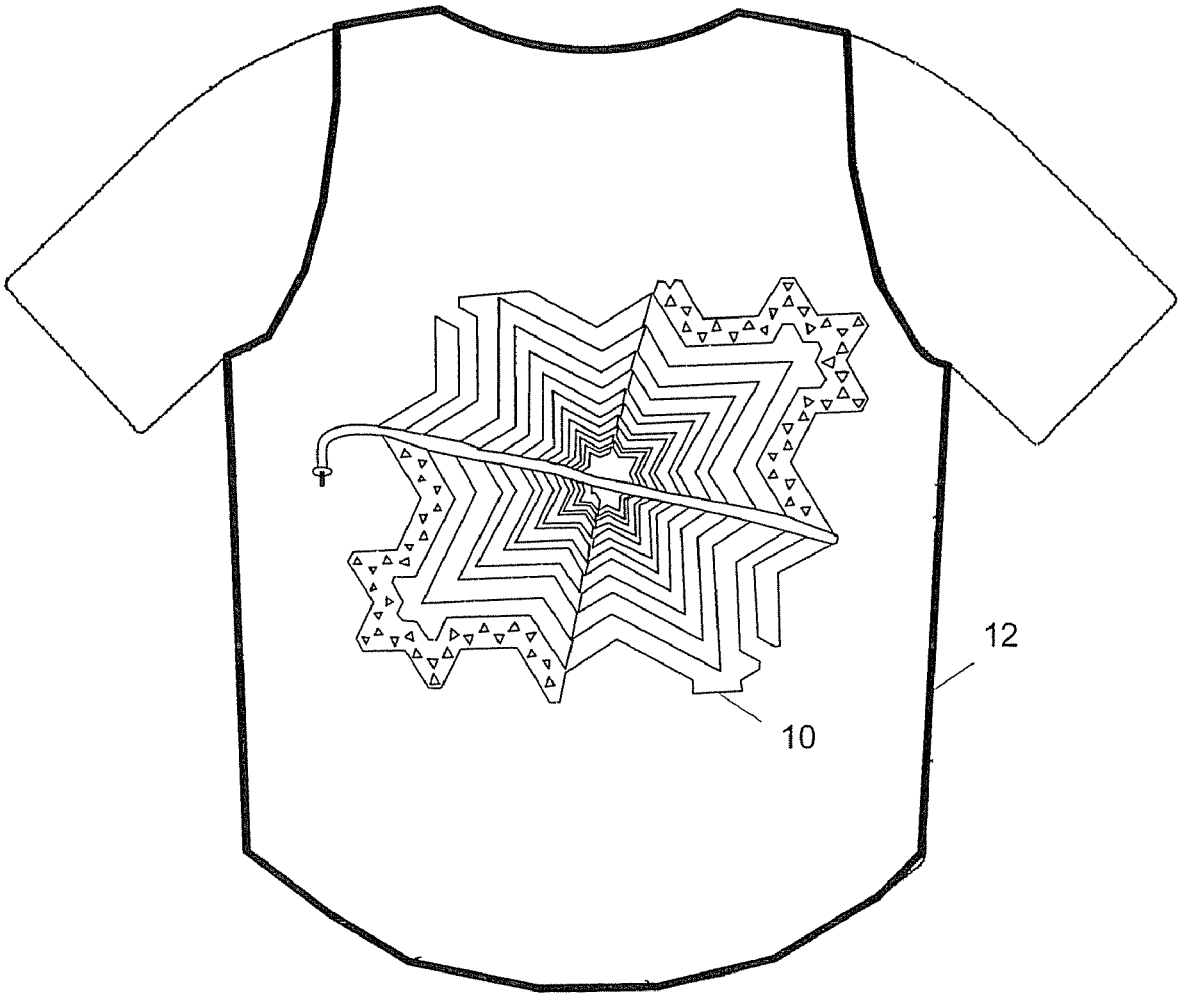
FIG. 1 is a diagrammatic view of a wideband antenna mounted to a garment.

Referring to FIG. 1, an antenna 10 is mounted conformal to a surface of a garment. In particular, antenna 10 is mounted to the back of a vest 12, however, in other arrangements the antenna 10 may be mounted to other types of garments such as shirts, coats, parkas, etc. By mounting antenna 10 to the back of vest 12, a fully integrated antenna is provided for various applications such as combat wear for military personnel. In some arrangements antenna 10 may be incorporated into a military "flak" vest or other similar military clothing known in the art for protecting soldiers in hazardous situations. Typically a flak vest is produced from light-weight material and includes conducting regions formed from a metalized cloth. Such cloth may be formed of a copper coated polyester fabric that is commercially available from Flectron Metalized Materials of St. Louis, Mo. However, any materials known in the art of clothing design and tailoring may be used to produce vest 12.

In this particular implementation, due to materials and production procedures, antenna 10 is opaque at visual wavelengths. However, in other implementations, antenna 10 may be substantially transparent at wavelengths in the visual portion of the electromagnetic spectrum. To mount antenna 10 conformal to vest 12, the antenna predominately extends in two dimensions (i.e., length and width) and is relatively thin to provide flexibility in movement. Rather than mounting antenna 10 directly to the outer surface of vest 12, the antenna may be embedded within one or more cloth layers of the vest. Some of these layers may be designed for particular capabilities, such as a bullet-proof layer or other types of projectile (e.g., flak) defection. For example, antenna 10 may be partially or fully embedded in one or more dielectric layer that are incorporated into the vest for bullet and/or flak deflection. A portion or all of this dielectric material may include one or more layers of foam or solid dielectric material. These layers of dielectric material may further be partially or fully embedded within another material. For example, antenna 10 may be embedded in a dielectric plate that is then wrapped around a fibrous dielectric material such as Tyvek®, which is produced by Dupont of Wilmington, Del.

Rather than incorporating antenna 10 into the clothing material of vest 12 (or other type of clothing article), the antenna may be incorporated into a pouch or other similar article capable of holding the antenna. By using a pouch, a person such as a soldier can position the antenna on various locations on his or her person. For example, a soldier may position the pouch on his chest or on his back to provide appropriate signal transmission and/or reception performance with other troops, a base, etc.

Along with being incorporated into an article of clothing or a pouch, antenna 10 is designed with a self-similar geometry that provides broad frequency coverage for signal transmission and/or reception. In general the self-similar shape is defined as a fractal geometry. Fractal geometry may be grouped into random fractals, which are also termed chaotic or Brownian fractals and include a random noise components, or deterministic fractals. Fractals typically have a statistical self-similarity at all resolutions and are generated by an infinitely recursive process. For example, a so-called Koch fractal may be produced with N iterations (e.g., N=1, N=2, etc.). One or more other types of fractal geometries may also be incorporated into the design of antenna 10.

By incorporating the fractal geometry into electrically conductive and non-conductive portions of antenna 10, the length and width of the conductive and non-conductive portions of the antenna is increased due to the nature of the fractal pattern. However, while the lengths and widths increase, the overall footprint area of antenna 10 is relatively small. By providing longer conductive paths, antenna 10 can perform over a broad frequency band. For example, the size reduction (relative to a wavelength) for the lowest frequency of operation approximately has a ratio of approximately 15:1 to 20:1.

Antenna 10 provides wideband frequency coverage for transmitting and/or receiving electromagnetic signals. For example, bandwidths ratios of 5:1 or larger may be supported by antenna 10. For this lower ratio (i.e., 5:1) antenna 10 may perform at frequencies within a broad frequency band, for example, of approximately 3000 Mega Hertz (MHz) to 15,000 MHz. However, it should be appreciated that performance within other frequency bands may be achieved. Thus, antenna 10 is capable of transmitting and receiving electromagnetic signals over a broad frequency range.

Figure 2:
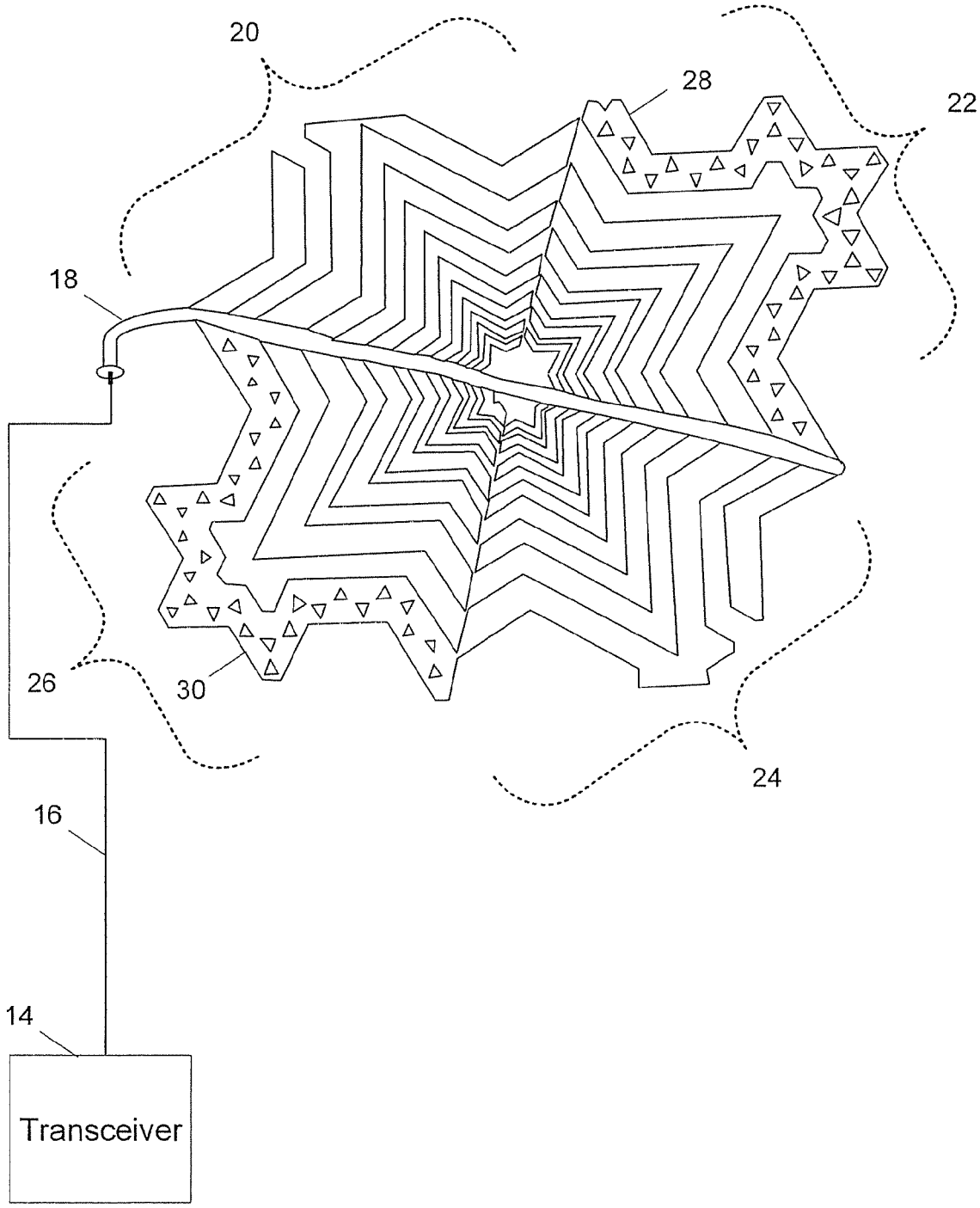
FIG. 2 is a diagrammatic view of the wideband antenna shown in FIG. 1.

Referring to FIG. 2, antenna 10 is connected to a transceiver 14 over a conductor 16 (e.g., a cable, conducting trace, wire, etc.). By connecting to antenna 10, transceiver 14 may send signals to the antenna for transmission or receive signals collected by the antenna. Typically to send and receive signals (and improve the gain of antenna 10), transceiver 10 includes a low noise amplifier (LNA) and a power amplifier (PA). To connect conductor 16 to antenna 10, a co-planar feed 18 is electrically connected to the antenna that also provides wideband performance. In some arrangements, a matching network is included in co-planar feed 18 to reduce signal dropouts (known as "suckouts") that are located within particular portions of the spectrum. Various techniques known to one skilled in the art of electronics and antenna system design may be implemented to connect connector 16 to antenna 10. For example, an electrically conductive epoxy may be used to provide an adhesive connection with appropriate electrical conductivity. Additionally, in some embodiments other electromagnetic and electronic devices and components may be connected to co-planar feed 18. For example, a power divider may be connected between conductor 16 and co-planar feed 18.

In this exemplary fractal antenna design, antenna 10 includes an electrically conductive portion and a non-conductive portion. In particular, antenna 10 includes four sections 20, 22, 24, 26 that include electrically conductive and non-conductive portions that implement a self-similar pattern (e.g., a fractal geometry). Both the conductive and non-conductive portions include extensions that include multiple angular bends to incorporate the self-similar pattern. In this example, each extension includes at least two angular bends. However, in other embodiments more angular bends may be incorporated to produce a similar fractal geometry or a different type of self-similar pattern.

In addition to incorporating a self-similar pattern into the conductive and non-conductive extensions, one or more self-similar patterns may be incorporated into the individual extensions. In this exemplary design, triangular holes are cut into two extensions 28 and 30 that are respectively included in section 22 and 26 of antenna 10. Along with being distributed throughout each extension in a self-similar manner, each individual triangular hole may implement a fractal geometry.

Various types of conductive materials may be used to produce the electrically conductive portion (i.e., self-similar extensions) of antenna 10. For example, various types of metallic material such as metallic tape, metallic paint, metallic ink or powder, metallic film, or other similar materials capable of conducting electricity may be selected. In this particular example, the electrically conductive portion of antenna 10 is produced from an electrically conductive coating that covers a non-conductive substrate. To produce the shape of the self-similar extensions, a laser or other type of cutting device may be used to ablate the conductive coating and from the non-conductive substrate.

By exposing portions of the non-conductive substrate, a boundary of the outer-most self-similar extensions is defined by a portion of the substrate. Additionally, exposed segments of the substrate define boundaries of the self-similar extensions. Various types of non-conductive materials may be used as a substrate to define the boundaries of the conductive portions of antenna 10. For example, these materials may include insulators (e.g., air, etc.), dielectrics (e.g., glass, fiberglass, plastics, etc.), semiconductors, and other materials that impede the flow of electricity.

In some embodiments, the non-conductive portions of antenna 10 are produced from a high quality plastic or fiberglass that is structurally sturdy and may be processed (e.g., shaped) relatively quickly. Along with impeding current flow, the non-conductive material also typically provides structural support to the conductive portion of antenna 10. To provide such support, the non-conductive materials may include materials typically used for support and/or re-enforce other materials. To protect antenna 10 (and provide structural support), a visually transparent (or semi-transparent) material may cover the conductive and non-conductive portions of the antenna. For example, both sides of antenna 10 may be covered by a transparent laminate that is applied with a thermal transfer. The electrically conductive portion and the non-conductive may also be cover by similar or dissimilar material. For example, one laminate may be used to cover the conductive portion of antenna 10 while another laminate is used to cover the non-conductive portion. These different laminates may be used to approximately match the optical appearance of both portions. Multiple layers of materials may also be used to cover the portions of antenna 10. For example, one layer of laminate may be applied to the electrically-conductive portions of antenna 10 and two or more layers of laminate may be applied to the non-conductive portions to match the optical appearances of the entire antenna.

In this exemplary design, the four portions 20-26 are configured to provide a dipole response pattern for transmission and/or reception. Alternatively, other antenna designs may be implemented (e.g., a phased array design, etc.) independent or in combination with the dipole design provided in the figure. To expand the frequency coverage of antenna 10, additional structure may be included in the antenna. For example, one or more conductors (e.g., conductive traces, wires, etc.) may be attached to some (or all) of the self-similar extensions. By including these conductive attachments, the frequency coverage of antenna may be significantly extended. For example, for this exemplary design, the frequency coverage may extend to relatively low frequencies.

Antenna 10 may be implemented into various types of antenna systems known to one skilled in the art of antenna design and antenna system design. In one scenario, antenna 10 may be used to transfer radio frequency (RF) signals among people such as military personnel in the field, various types of instillations (e.g., bases, etc.), and/or telecommunication equipment (e.g., wireless telephones, cellular telephones, satellites, etc.).

Along with wideband frequency coverage for broadband operations, by incorporating a fractal geometry into antenna 10 to increase conductive trace length and width, antenna losses are reduced. By reducing antenna loss, the output impedance of antenna 10 is held to a nearly constant value across the operating range of the antenna. For example, a 50-ohm output impedance may be provided by antenna 10 across the operational frequency band.

Figure 3:
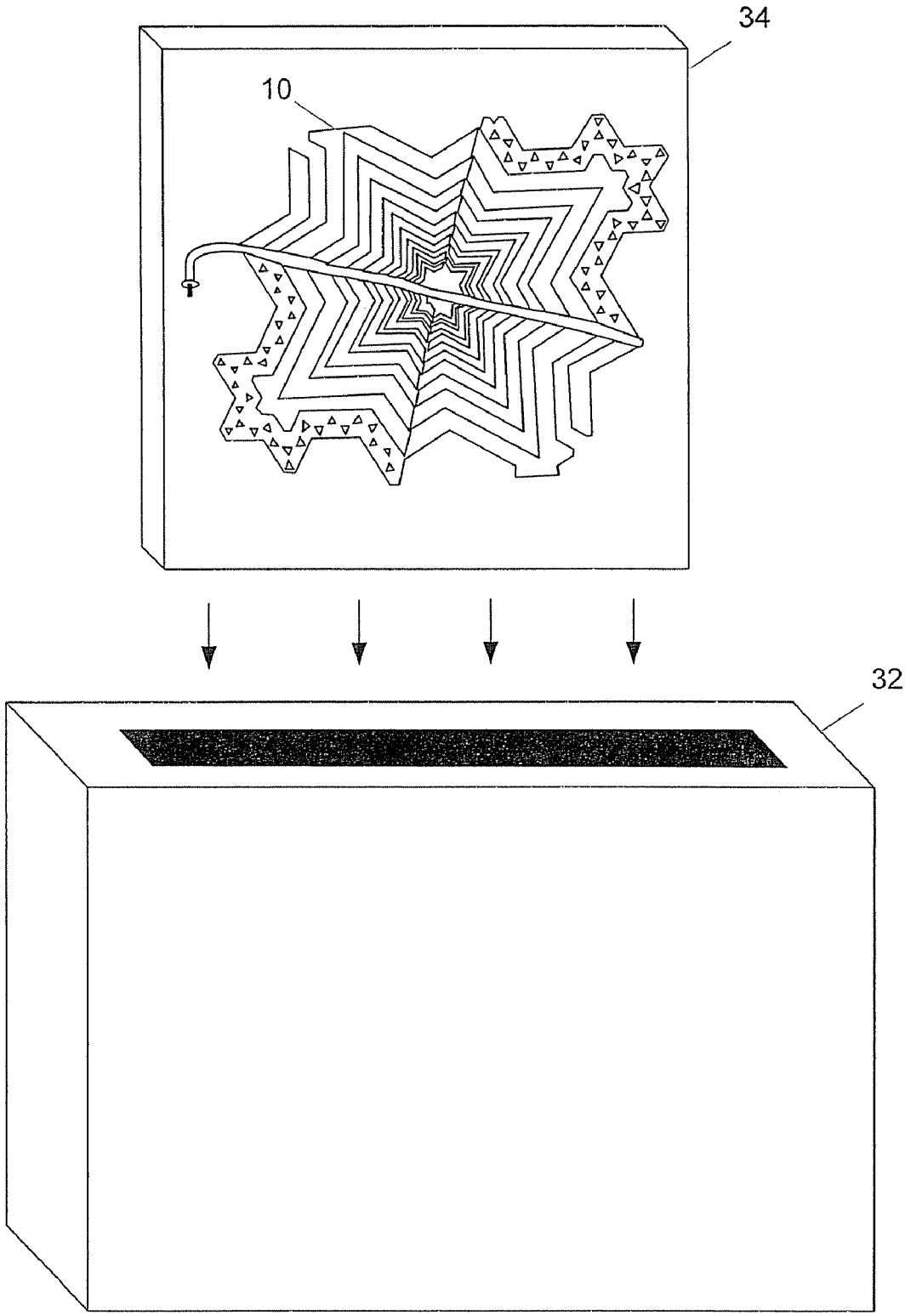
FIG. 3 is a diagrammatic view of a pouch that holds the wideband antenna and may be mounted to the garment shown in FIG. 1.

Referring to FIG. 3, a pouch 32 is shown in which antenna 10 may be inserted. In this particular arrangement, antenna 10 is mounted to a plate 34 that provides structural support. By inserting antenna 10 in pouch 32, the antenna may be positioned upon various locations of a person that is carrying the pouch. For example, pouch 32 may be attached to the front, back, or side of vest or other type of clothing worn over the torso. Along with wearing pouch 32 external to a piece of clothing or garment, the pouch may be worn under a garment or inserted into between clothing layers of a garment. As mentioned above, various types of material may be incorporated into the pouch. For example, pouch 32 may include one or more layers of foam or solid dielectric material. Fibrous material such as Tyvek™ may also be implemented to cover or wrap around antenna 10. To attach pouch 32 to a garment of a piece of clothing, various techniques known in the art of clothing design and tailoring may be implemented. For example, Velcro™, straps, hooks, or other similar materials and/or mechanisms may implemented for attaching the pouch. In this exemplary design, one antenna (i.e., antenna 10) is inserted into pouch 32, however, in other implementation, a pouch may be produced that is capable of holding two or more antennas to increase directional coverage. Furthermore, by including electronic equipment such as a power divider in pouch 32, signals may be split among the multiple antennas. Structural plate 34 may be produced from various materials, for example, the plate may be produced from one or more dielectric materials (e.g., ceramic). In addition to providing structural support, plate 34 may also increase the distance between antenna 10 and the body for the person (e.g., a soldier) that is carrying pouch 32. For example, pouch 32 maybe positioned on the back of a person such that plate 34 provides a separation distance between antenna 10 and the person's back. This separation distance increases the electric distance between the person and antenna 10 and thereby reduces the interference effects caused by the person's body. By decreasing this interference, performance improves for antenna 10. In this exemplary design, antenna 10 and plate 34 are inserted into pouch 32 that is positioned on a person's body (e.g., back, chest, etc.). However, in other designs plate 34 may be positioned without the need of pouch 32.

Figure 4:
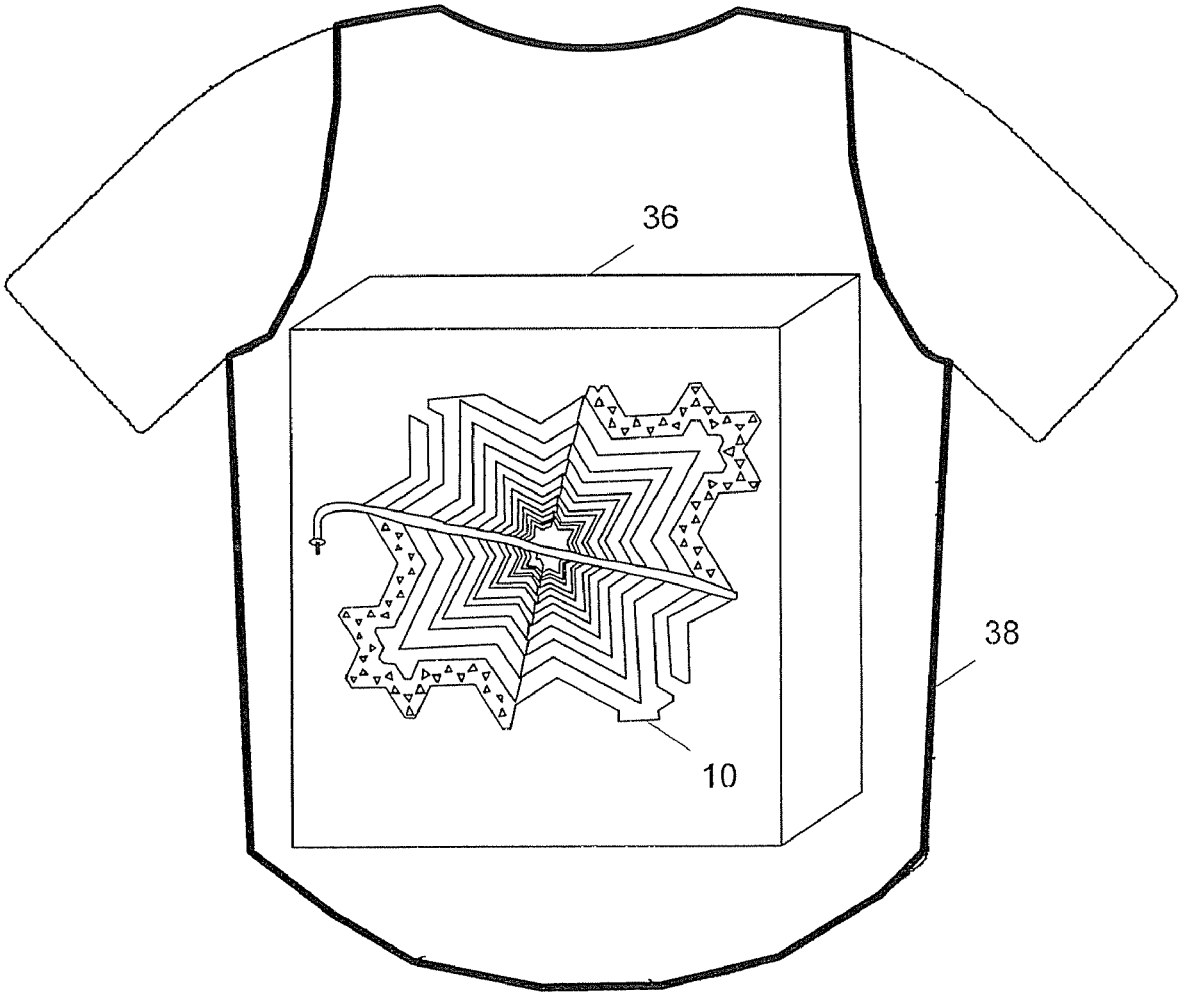
FIG. 4 is a diagrammatic view of wideband antenna embedded into a projectile deflecting plate that is mounted on a garment.

Referring to FIG. 4, antenna 10 is embedded in a structural plate 36 that is attached to the back of a vest 38. Similar to plate 34 (shown in FIG. 4), structural plate 36 also separates antenna 10 from the body of the person wearing vest 38. By providing this separation, the performance of antenna 10 improves since the separation reduces the interference effects of the person's body. Also, by implementing various types of material into plate 36, additionally capabilities may be provided. For example, projectile deflection materials known to one skilled in the art of armor design and personnel protection technology may be incorporated into plate 36. Various types of bullet deflecting and/or flak deflecting materials may be incorporated into the exterior surface or inner layers of plate 36.

A number of implementations have been described. Nevertheless, it will be understood that various modifications may be made. Accordingly, other implementations are within the scope of the following claims.

What is claimed is:

1. A portable antenna system comprising:

an antenna that includes (i) an electrically conductive portion including electrically conductive traces each including a fractal pattern based on an acute angle, and (ii) an electrically non-conductive portion that structurally supports the electrically conductive portion; and an article of clothing, wherein the antenna is fixedly attached to a surface ofthe article of clothing such that electrically conductive traces extend across the surface of the article of clothing.

2. The portable antenna system of claim 1, wherein the traces include two or more angular bends.

3. The portable antenna system of claim 1, further comprising:

a co-planar feed connected to the antenna for transmitting and/or receiving electromagnetic signals through the antenna.

4. The portable antenna system of claim 1, wherein the antenna is configured to transmit electromagnetic energy across a spectral bandwidth that is defined by a ratio of at least 5:1.

5. The portable antenna system of claim 1, wherein the antenna is configured to receive electromagnetic energy across a spectral bandwidth that is defined by a ratio of at least 5:1.

6. The portable antenna system of claim 1, further comprising:

a dielectric plate to which the antenna is mounted.

7. The portable antenna system of claim 6, wherein the dielectric plate is capable of deflecting projectiles.

8. The portable antenna system of claim 1, wherein the antenna is mounted on an internal clothing layer of the article of clothing.

9. The portable antenna system of claim 1, wherein the antenna is mounted to an exterior surface of the article of clothing.

10. The portable antenna system of claim 1, wherein the article of clothing is a vest.

* * * * *